US006561255B1

(12) United States Patent
Mullet

(10) Patent No.: US 6,561,255 B1
(45) Date of Patent: May 13, 2003

(54) OVERHEAD DOOR LOCKING OPERATOR

(75) Inventor: Willis J. Mullet, Pensacola Beach, FL (US)

(73) Assignee: Wayne-Dalton Corp., Mt. Hope, OH (US)

( * ) Notice: Subject to any disclaimer, the term of this patent is extended or adjusted under 35 U.S.C. 154(b) by 0 days.

(21) Appl. No.: 09/548,191

(22) Filed: Apr. 13, 2000

(51) Int. Cl.[7] ..... E05F 15/10

(52) U.S. Cl. ..... 160/188; 160/201; 192/69.82; 192/93 R; 192/138; 192/139; 192/143

(58) Field of Search ..... 160/188, 310, 160/201; 49/139, 140; 192/69.82, 93 R, 138, 143, 139

(56) References Cited

U.S. PATENT DOCUMENTS

| | | | | | |
|---|---|---|---|---|---|
| 1,827,433 | A | * | 10/1931 | Kendall | |
| 2,703,236 | A | * | 3/1955 | Verdier | |
| 2,742,280 | A | | 4/1956 | Wilcox | 268/59 |
| 4,085,629 | A | | 4/1978 | Fogarollo | 74/625 |
| 4,098,023 | A | | 7/1978 | Slopa | 49/139 |
| 4,167,833 | A | * | 9/1979 | Farina et al. | |
| 4,191,237 | A | * | 3/1980 | Voege | |
| 4,472,910 | A | | 9/1984 | Iha | 49/139 |
| 4,618,174 | A | | 10/1986 | Duke | 292/135 |
| 4,852,706 | A | | 8/1989 | Pietrzak et al. | 192/8 |
| 4,884,831 | A | | 12/1989 | Emon | 292/38 |
| 4,941,320 | A | * | 7/1990 | Kersten et al. | |
| 4,954,810 | A | | 9/1990 | Llewellyn | |
| 4,976,168 | A | * | 12/1990 | Lotznicker et al. | |
| 4,993,533 | A | | 2/1991 | Brown | 192/114 |
| 5,419,010 | A | | 5/1995 | Mullet | 16/198 |
| 5,509,233 | A | | 4/1996 | Peterson | 49/139 |
| 5,557,887 | A | * | 9/1996 | Fellows et al. | |
| 5,698,073 | A | * | 12/1997 | Vincenzi | |
| 5,931,212 | A | * | 8/1999 | Mullet et al. | |
| 6,179,036 | B1 | * | 1/2001 | Harvey | |

FOREIGN PATENT DOCUMENTS

| | | | | |
|---|---|---|---|---|
| DE | 88 15 823 U | 4/1989 | ..... | E05F/15/10 |
| DE | 93 10 534 U | 10/1993 | ..... | H05B/39/04 |
| EP | 0 939 189 A | 9/1999 | ..... | E05F/15/16 |
| WO | WO 99 07971 A | 2/1999 | ..... | E05F/15/00 |
| WO | WO 00 50720 A | 8/2000 | ..... | E05F/15/16 |

* cited by examiner

*Primary Examiner*—Blair M. Johnson
(74) *Attorney, Agent, or Firm*—Renner, Kenner, Greive, Bobak, Taylor & Weber

(57) ABSTRACT

An operator (10,210) for moving in upward and downward directions a sectional door (D) having a counterbalancing system (30) including a drive tube (31) interconnected with the door comprising, a reversible motor (41), a drive gear (52) selectively driven in two directions by the motor, a driven gear (54) freely rotatably mounted on the drive tube and engaging the drive gear, a slide guide (56) non-rotatably mounted on the drive tube, a disconnect (70) mounted on the slide guide and selectively movable between a first position rotatably connecting the driven gear and the slide guide and a second position disconnecting the drive gear and the slide guide, and an actuator (80) for selectively moving the disconnect between the first position and the second position.

27 Claims, 8 Drawing Sheets

OVERHEAD DOOR LOCKING OPERATOR

TECHNICAL FIELD

The present invention relates generally to operators for sectional overhead doors. More particularly, the present invention relates to a type of "jack-shaft" operator for manipulating a sectional overhead door between the open and closed positions. More specifically, the present invention relates to a jack-shaft operator for a sectional overhead door which is highly compact, operates to lock the door in the closed position, and has a mechanical disconnect.

BACKGROUND ART

Motorized apparatus for opening and closing sectional overhead doors has long been known in the art. These powered door operators were developed in part due to extremely large, heavy commercial doors for industrial buildings, warehouses, and the like where opening and closing of the doors essentially mandates power assistance. Later, homeowners' demands for the convenience and safety of door operators resulted in an extremely large market for powered door operators for residential usage.

The vast majority of motorized operators for residential garage doors employ a trolley-type system that applies force to a section of the door for powering it between the open and closed positions. Another type of motorized operator is known as a "jack-shaft" operator, which is used virtually exclusively in commercial applications and is so named by virtue of similarities with transmission devices where the power or drive shaft is parallel to the driven shaft, with the transfer of power occurring mechanically, as by gears, belts, or chains between the drive shaft and a driven shaft, normally part of the door counterbalance system, controlling door position. While some efforts have been made to configure hydraulically or pneumatically-driven operators, such efforts have not achieved any substantial extent of commercial acceptance.

The well-known trolley-type door operators are normally connected directly to the top section of a garage door and for universal application may be powered to operate doors of vastly different size and weight, even with little or no assistance from a counterbalance system for the door. Since the operating force capability of trolley-type operators is normally very high, force adjustments are normally necessary and provided to allow for varying conditions and to allow the operator to be tuned, depending on the application. When a garage door and trolley-type operator are initially installed and both adjusted for optimum performance, the overhead door system can perform well as designed. However, as the system ages, additional friction develops in door and operator components due to loss of lubrication at rollers and hinges. Also, the door can absorb moisture and become heavier, and counterbalance springs can lose some of their original torsional force. These and similar factors can significantly alter the operating characteristics seen by the operator, which may produce erratic door operation such as stops and reversals of the door at unprogrammed locations in the operating cycle.

Rather than ascertaining and correcting the conditions affecting door performance, which is likely beyond a homeowner's capability, or engaging a qualified service person, homeowners frequently increase the force adjustment to the maximum setting. However, setting an operator on a maximum force adjustment creates an unsafe condition in that the operator becomes highly insensitive to obstructions. In the event a maximum force setting is effected on a trolley-type operator, the unsafe condition may also be dramatically exemplified in the event of a broken spring or springs. In such case, if the operator is disconnected from the door in the fully open position during an emergency or if faulty door operation is being investigated, one half or all of the uncounterbalanced weight of the door may propel the door to the closed position with a guillotine-like effect.

Another problem with trolley-type door operators is that they do not have a mechanism for automatically disengaging the drive system from the door if the door encounters an obstruction. This necessitates the considerable effort and cost which has been put into developing a variety of ways, such as sensors and encoders, to signal the operator controls when an obstruction is encountered. In virtually all instances, manual disconnect mechanisms between the door and operator are required to make it possible to operate the door manually in the case of power failures or fire and emergency situations where entrapment occurs and the door needs to be disconnected from the operator to free an obstruction. These mechanical disconnects, when coupled with a maximum force setting adjustment of the operator, can readily exert a force on a person or object which may be sufficiently high to bind the disconnect mechanism and render it difficult, if not impossible, to actuate.

In addition to the serious operational deficiencies noted above, manual disconnects, which are normally a rope with a handle, must extend within six feet of the floor to permit grasping and actuation by a person. In the case of a garage opening for a single car, the centrally-located manual disconnect rope and handle, in being positioned medially, can catch on a vehicle during door movement or be difficult to reach due to its positioning over a vehicle located in the garage. Trolley-type door operators raise a host of peripheral problems due to the necessity for mounting the operator to the ceiling or other structure substantially medially of and to the rear of the sectional door in the fully open position.

Operationally, trolley-type operators are susceptible to other difficulties due to their basic mode of interrelation with a sectional door. Problems are frequently encountered by way of misalignment and damage because the connecting arm of the operator is attached directly to the door for force transmission, totally independent of the counterbalance system. Another source of problems is cause by the necessity for a precise, secure mounting of the motor and trolley rails which may not be optimally available in many garage structures. Thus, trolley-type operators, although widely used, do possess certain disadvantageous and in certain instances even dangerous characteristics.

The usage of jack-shaft operators has been limited virtually exclusively to commercial building applications where a large portion of the door stays in the vertical position. This occurs where a door opening may be 15, 20, or more feet in height, with only a portion of the opening being required for the ingress and egress of vehicles. These jack-shaft operators are not attached to the door but attach to a component of the counterbalance system, such as the shaft or a cable drum. Due to this type of connection to the counterbalance system, these operators require that a substantial door weight be maintained on the suspension system, as is the case where a main portion of the door is always in a vertical position. This is necessary because jack-shaft operators characteristically only drive or lift the door from the closed to the open position and rely on the weight of the door to move the door from the open to the closed position, with the suspension cables attached to the counterbalance system controlling only the closing rate.

Such a one-way drive in a jack-shaft operator produces potential problems if the door binds or encounters an obstruction upon downward movement. In such case, the operator may continue to unload the suspension cables, such that if the door is subsequently freed or the obstruction is removed, the door is able to free-fall, with the potential of damage to the door or anything in its path. Such unloading of the suspension cables can also result in the cables coming off the cable storage drums, thus requiring substantial servicing before normal operation can be resumed.

Jack-shaft operators are normally mounted outside the tracks and may be firmly attached to a door jamb rather than suspended from the ceiling or wall above the header. While there is normally ample jamb space to the sides of a door or above the header in a commercial installation, these areas frequently have only limited space in residential garage applications. Further, the fact that the normal jack-shaft operators require much of the door to be maintained in a vertical position absolutely mitigates against their use in residential applications where the door must be capable of assuming essentially a horizontal position since, in many instances, substantially the entire height of the door opening is required for vehicle clearance during ingress and egress.

In order to permit manual operation of a sectional door in certain circumstances, such as the loss of electrical power, provision must be made for disconnecting the operator from the drive shaft. In most instances this disconnect function is effected by physically moving the drive gear of the motor out of engagement with a driven gear associated with the drive shaft. Providing for such gear separation normally results in a complex, oversized gear design which is not compatible with providing a compact operator which can feasibly be located between the drive shaft for the counterbalance system and the door. Larger units to accommodate gear design have conventionally required installation at or near the end of the drive shaft which may result in shaft deflection that can cause one of the two cables interconnecting the counterbalance drums and the door to carry a disproportionate share of the weight of the door.

Another common problem associated particularly with jack-shaft operators is the tendency to generate excessive objectionable noise. In general, the more components, and the larger the components, employed in power transmission the greater the noise level. Common operator designs employing chain drives and high speed motors with spur gear reducers are notorious for creating high noise levels. While some prior art operators have employed vibration dampers and other noise reduction devices, most are only partially successful and add undesirable cost to the operator.

Another requirement in jack-shaft operators is mechanism to effect locking of the door when it is in the closed position. Various types of levers, bars and the like have been provided in the prior art which are mounted on the door or on the adjacent track or jamb and interact to lock the door in the closed position. In addition to the locking mechanism which is separate from the operator there is normally an actuator which senses slack in the lift cables which is caused by a raising of the door without the operator running, as in an unauthorized entry, and activates the locking mechanism. Besides adding operational complexity, such locking mechanisms also introduce an additional undesirable cost to the operator system.

DISCLOSURE OF THE INVENTION

Therefore, an object of the present invention is to provide a motorized operator for a sectional door wherein a component of the operator moves into physical engagement with the door to effect a locking function when the door reaches the closed position. Another object of the present invention is to provide such a motorized operator wherein the motor pivots into contact with the door to effect locking of the door in the closed position. A further object of the present invention is to provide such a motorized operator wherein a worm output of the motor and a driven worm wheel attached to the drive tube of a counterbalancing system remain in operative contact throughout the door operating cycle, thereby permitting the utilization of reduced size gears and permitting a smaller operator package. Still another object of the present invention is to provide such a motorized operator which does not require a locking mechanism or actuator therefore as components separate from the operator itself.

Another object of the present invention is to provide a motorized operator for sectional doors that has a disconnect that may be manually actuated from a location remote from the operator. A further object of the present invention is to provide such a motorized operator wherein actuation of the manual disconnect accomplishes both the separation of the operator from the counterbalance system and the unlocking of the door, whereby the door may be manually lifted from the closed position with assistance of the counterbalance system. A further object of the invention is to provide such an operator wherein the manual disconnect does not disturb the meshed relationship interconnecting the operator motor and the remainder of the drive gear system.

Another object of the present invention is to provide a motorized operator for sectional doors that eliminates the need for any physical attachment to the door in that it is mounted proximate to and operates through the counterbalance system and may be positioned at any location along the width of the door, preferably centrally thereof. A further object of the present invention is to provide such a motorized operator that may serve to reduce deflection of the counterbalance drive shaft to which it is directly coupled to provide prompt, direct feedback from any interruptions and obstructions which may effect the door during travel. Yet a further object of the invention is to provide such an operator which can be readily sized to fit within the area defined by the tracks at the sides of the door, the drive tube or drive shaft of the counterbalance system and the travel profile of the door. Still another object of the invention is to provide such an operator which can be mounted in an area thus defined while moving between a non-interfering operating position and a locking position wherein a portion of the operator physically engages the inner surface of the door proximate to the top. Still another object of the present invention is to provide such a motorized operator wherein a portion of the operator clamps the top of the door against the header to create resistence to forced entry, air infiltration, water infiltration, and forces created by wind velocity pressure acting on the outside of the door.

Still another object of the present invention is to provide a motorized operator for sectional doors that does not require trolley rails, bracing for drive components, or any elements suspended from the ceiling or above the header or otherwise outside the area defined by the tracks, the counterbalance system and the door operating path. Yet another object of the present invention is to provide such an operator wherein the number of component parts is greatly reduced from conventional operators such as to provide improved reliability and quicker and easier installation. Yet another object of the invention is to provide such an operator which has fewer component parts subject to wear, requires less maintenance, achieves a longer operating life, while achieving quieter operation and less vibration due to a reduction in the number and size of rotating and other drive components.

In general, the present invention contemplates an operator for moving in upward and downward directions a sectional door having a counterbalancing system with a drive tube interconnected with the door including, a reversible motor, a drive gear selectively driven in two directions by the motor, a driven gear freely rotatably mounted on the drive tube and engaging the drive gear, a slide guide non-rotatably mounted on the drive tube, a disconnect mounted on the slide guide and selectively movable between a first position rotatably connecting the driven gear and the slide guide and a second position disconnecting the drive gear and the slide guide, and an actuator for selectively moving the disconnect between the first position and the second position.

PREFERRED EMBODIMENT FOR CARRYING OUT THE INVENTION

Figure 1:
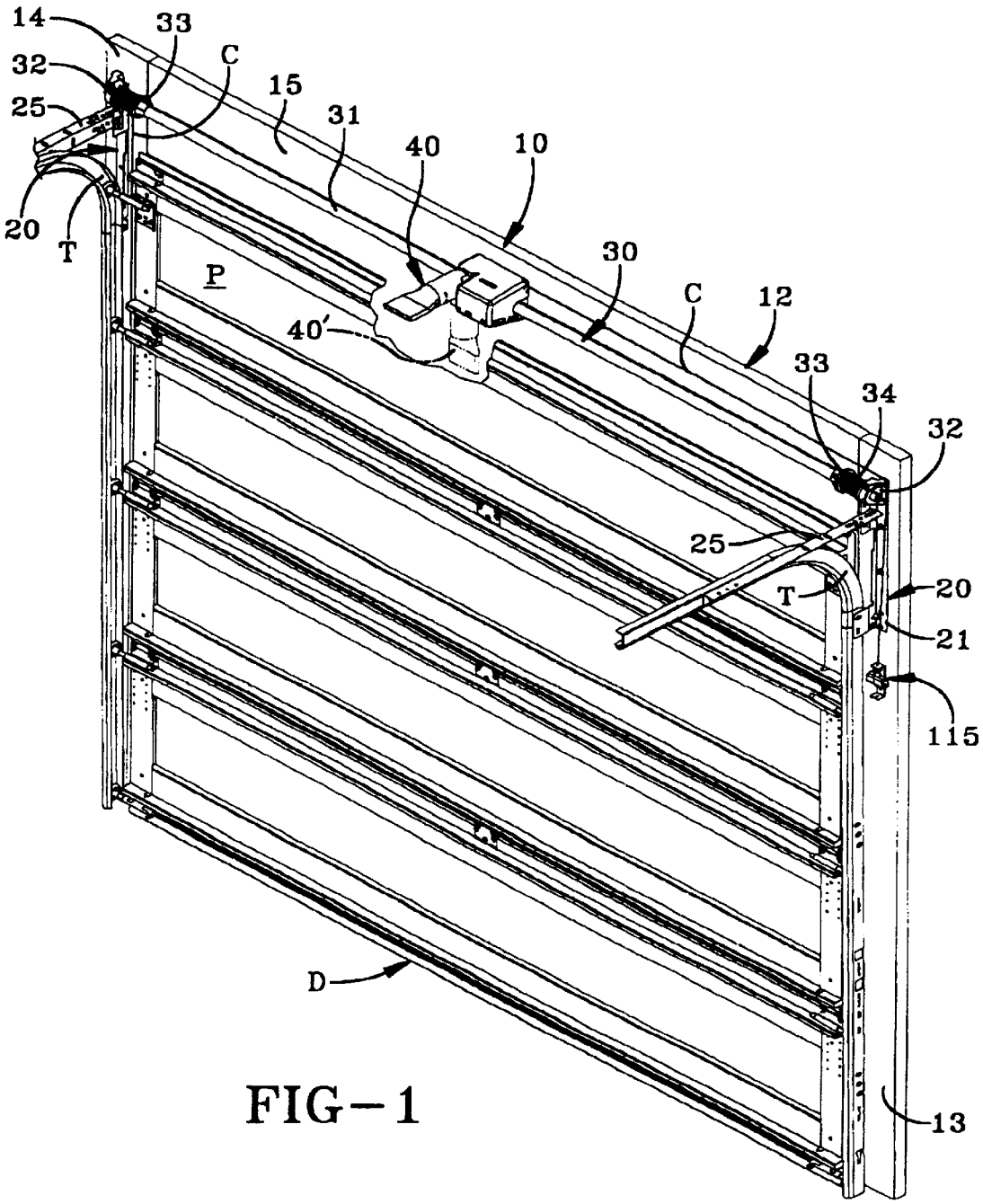
FIG. 1 is a rear perspective view of a sectional overhead garage door installation showing a motorized operator according to the concepts of the present invention installed in operative relation thereto, with the operator depicted in its operating position in solid lines and the door locking position in chain lines.

A motorized operator system according to the concepts of the present invention is generally indicated by the numeral 10 in the drawing figures. The operator system 10 is shown in FIG. 1 mounted in conjunction with a sectional door D of a type commonly employed in garages for residential housing. The opening in which the door D is positioned for opening and closing movements relative thereto is defined by a frame, generally indicated by the numeral 12, which consists of a pair of spaced jambs 13, 14 that, as seen in FIG. 1, are generally parallel and extend vertically upwardly from the floor (not shown). The jambs 13, 14 are spaced and joined at their vertically upper extremity by a header 15 to thereby delineate a generally inverted U-shaped frame 12 around the opening for the door D. The frame 12 is normally constructed of lumber, as is well known to persons skilled in the art, for purposes of reinforcement and facilitating the attachment of elements supporting and controlling door D, including the operator system 10.

Affixed to the jambs 13, 14 proximate the upper extremities thereof and the lateral extremities of the header 15 to either side of the door D are flag angles, generally indicated by the numeral 20. The flag angles 20 generally consist of L-shaped vertical members 21 having a leg 22 attached to an underlying jamb 13, 14 and a projecting leg 23 preferably disposed substantially perpendicular to the leg 22 and, therefore, perpendicular to the jambs 13, 14 (See FIG. 6).

Flag angles 20 also include an angle iron 25 positioned in supporting relation to tracks T, T located to either side of door D. The tracks T, T provide a guide system for rollers attached to the side of door D, as is well known to persons skilled in the art. The angle irons 25 normally extend substantially perpendicular to the jambs 13, 14 and may be attached to the transitional portion of tracks T, T between the vertical section and the horizontal section thereof or in the horizontal section of tracks T, T. The tracks T, T define the travel of the door D in moving upwardly from the closed to open position and downwardly from the open to closed position.

The operator system 10 may be electrically interconnected with a ceiling unit, which may contain a power supply, a light, a radio receiver with antenna for remote actuation of operator system 10 in a manner known in the art, and other operational peripherals. The ceiling unit may be electrically interconnected with a wall unit having an up/down button, a light control, and controls for other known functions.

Figure 2:
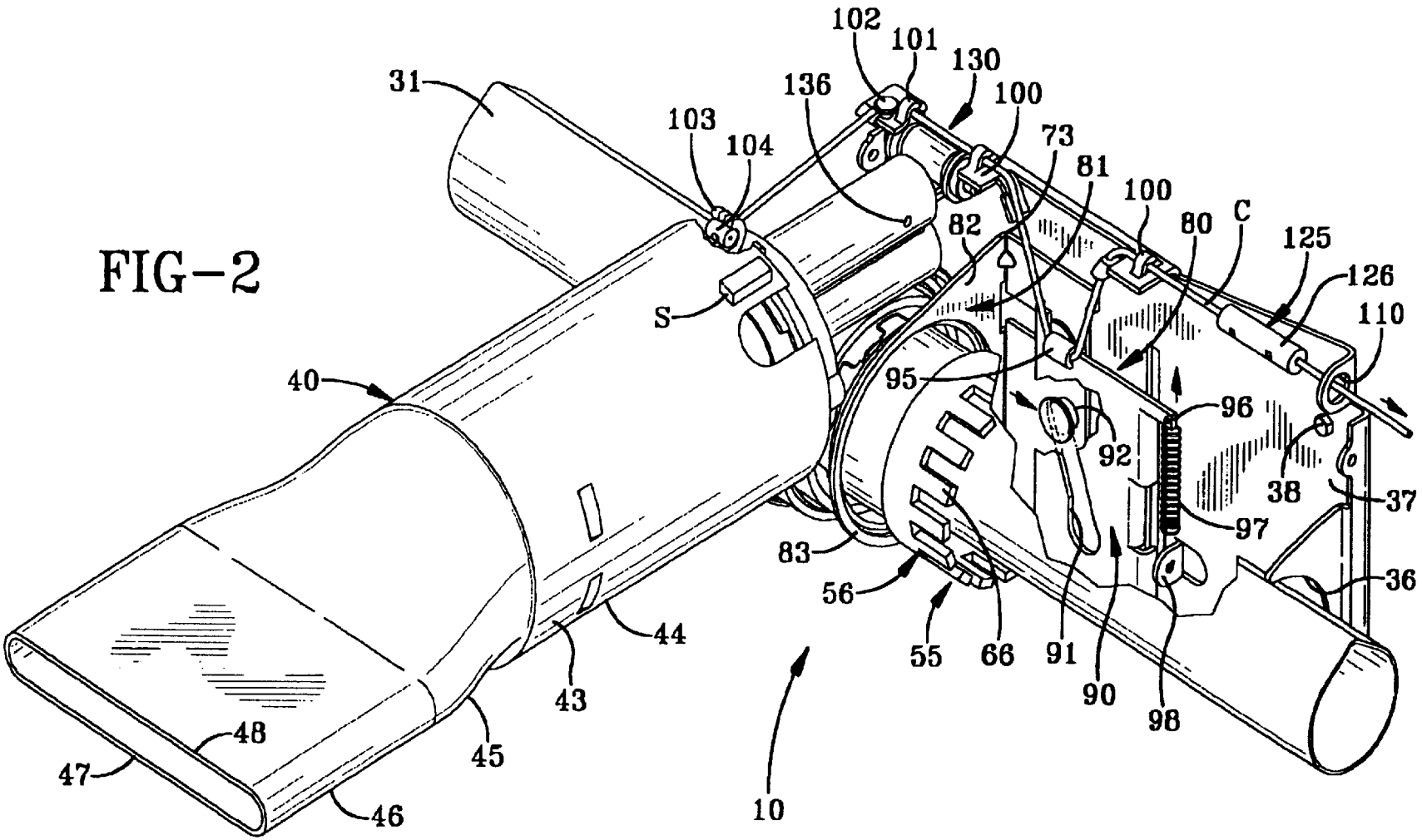
FIG. 2 is an enlarged perspective view of the motorized operator of FIG. 1 with the cover removed and portions broken away to show the mechanical interconnection of the motorized operator with the drive tube of the counterbalancing system.

Referring now to FIGS. 1 and 2 of the drawings, the operator system 10 mechanically interrelates with the door D through a counterbalance system, generally indicated by the numeral 30. As shown, the counterbalance system 30 includes an elongate drive tube 31 extending between tensioning assemblies 32, 32 positioned proximate each of the flag angles 20. While the exemplary counterbalance system 30 depicted herein is advantageously in accordance with U.S. Pat. No. 5,419,010, it will be appreciated by persons skilled in the art that operator system 10 could be employed with a variety of torsion-spring counterbalance systems. In any instance, the counterbalance system 30 includes cable drum mechanisms 33 positioned on the drive tube 31 proximate the ends thereof which rotate with drive tube 31. The cable drum mechanisms 33 each have a cable 34 reeved thereabout which is affixed to the door D preferably proximate the bottom, such that rotation of the cable drum mechanisms 33 operates to open or close the door D in conventional fashion.

As seen in FIGS. 1 and 2, the operator system 10 has an operator housing 35 which may conveniently enclose a length of the drive tube 31. While drive tube 31 is depicted as a hollow tubular member that is non-circular in cross-section, it is to be appreciated that circular drive tubes, solid shafts, and other types of driving elements that rotate cable drums, such as cable drum mechanisms 33, may be employed in conjunction with the operator system 10 of the instant invention and are encompassed within this terminology in the context of this specification.

The operator housing 35 has apertures 36 at either end through which drive tube 31 extends. Operator housing 35 has a mounting plate 37 that may be attached to the header 15 as by a plurality of cap screws 38 (FIG. 2). While operator housing 35 is shown mounted in relation to drive tube 31 substantially medially between the cable drum mechanisms 33, 33, it is to be noted that with the depicted counterbalance system 30, the operator housing 35 could be mounted at any desired location along drive tube 31 should it be necessary or desirable to avoid an overhead or wall obstruction in a particular garage design. Operatively interrelated with the operator housing 35 is an operator motor assembly, generally indicated by the numeral 40. For purposes of powering the door D, the operator motor assembly 40 has an electric motor 41 constituting one of various types employed for overhead doors which is designed for stop, forward and reverse rotation of a motor shaft 42. As seen particularly in FIGS. 1, 2 and 4 the operator motor assembly 40 maybe provided with a motor cover 43. As shown, the motor cover 43 has a cylindrical portion 44 that overlies electric motor 41. Motor cover 43 may have an axial extension consisting of a truncated portion 45 of tapering dimensions terminating in an elongated oval portion 46 having flat parallel sides 47 and 48. The oval portion 46 of motor cover 43 has the flat side 47 positioned for engagement with the top of the top panel P of the door D when the operator motor assembly 40 is in the door locked position depicted in chain lines as 45 in FIG. 1. The wide, flat surface 47 may be advantageous in providing an enlarged contact area for locking engagement with the top of panel P to urge the panel P into contact with the header 15 to effect sealing engagement of panel P with the door frame 12. In the operating position of operator motor assembly 40 depicted in FIG. 1, the motor cover 43 extends only slightly above drive tube 31 and is essentially horizontally aligned with cable drum mechanisms 33, 33 and tensioning assemblies 32, 32 such as to remain vertically as well as laterally within the confines of the counterbalance system 30.

Figure 3:
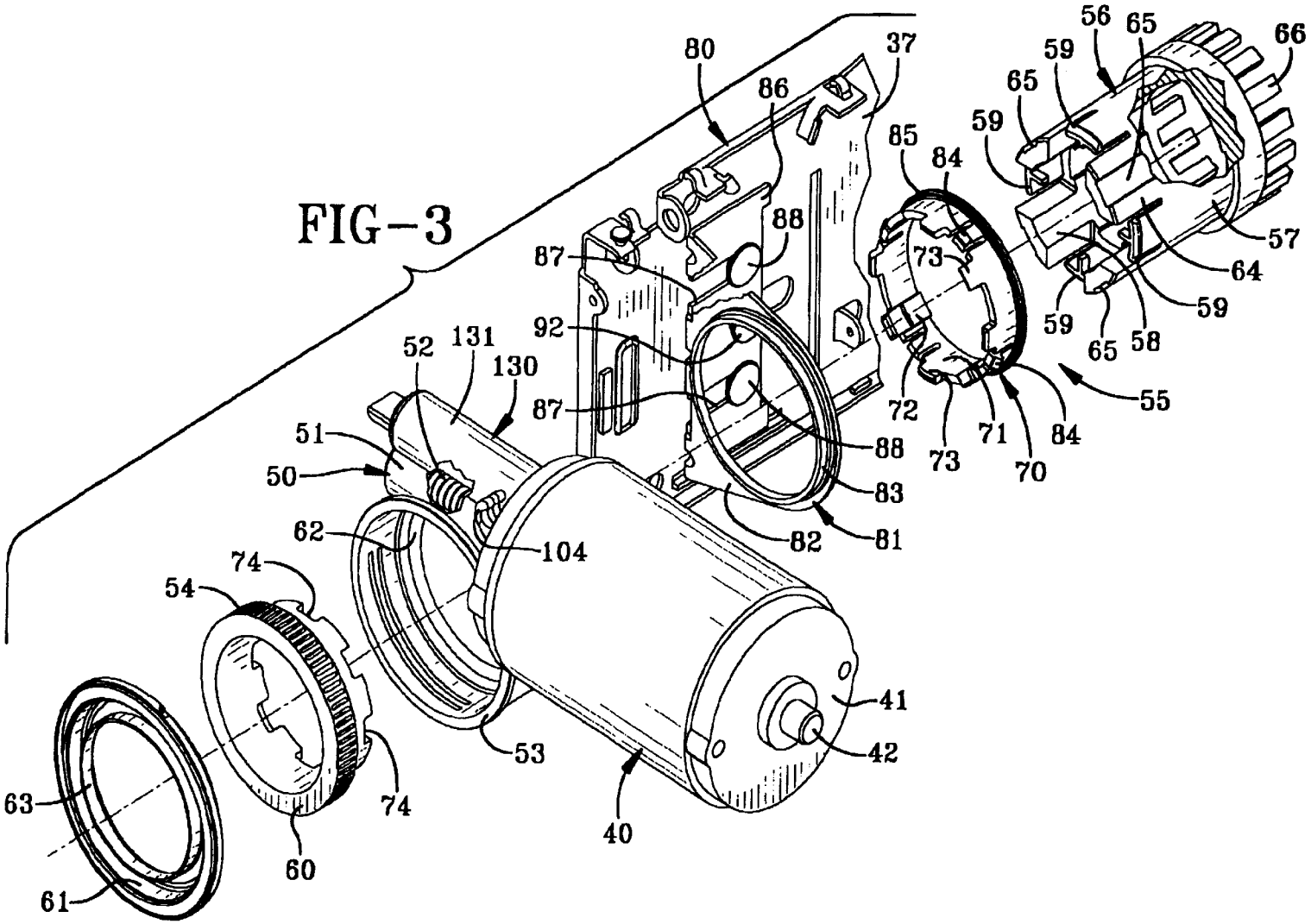
FIG. 3 is a further enlarged exploded perspective view showing details of the drive system and the disconnect assembly.
Figure 4:
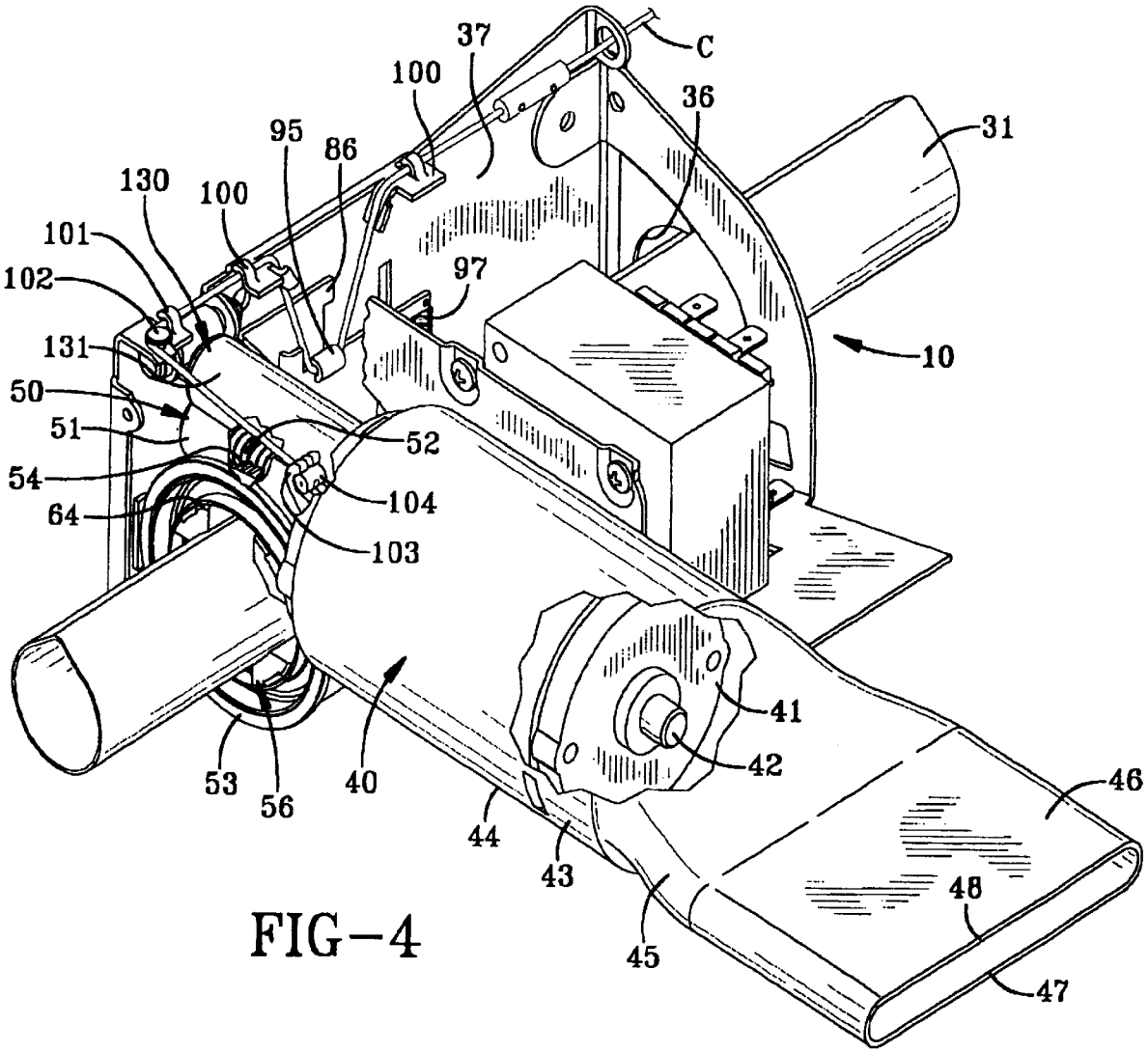
FIG. 4 is a further enlarged perspective view of the motorized operator of FIG. 1 with portions of the cover broken away to show additional details of the drive elements and the disconnect assembly.

Referring particularly to FIGS. 3 and 4, a drive train enclosure, generally indicated by the numeral 50, projects from the motor cover 43 in the direction opposite the truncated portion 45 thereof. The drive train enclosure 50 has a hollow cylindrical extension portion 51 which extends from motor cover 43. The cylindrical portion 51 of drive train enclosure 50 accommodates a worm 52 which is attached to or may be cut into the shaft 42 of motor 41. The drive train enclosure 50 also includes an open-ended cylindrical journal 53 which intercommunicates through the wall thereof with the interior of cylindrical portion 51 of drive train enclosure 50 and particularly with the worm 52 reposing therein. As best seen in FIGS. 3 and 4, the journal 53 seats internally thereof a worm wheel 54 which is at all times positioned in mating engagement with the worm 52 of electric motor 41.

The drive tube 31 of counterbalance system 30 is selectively rotationally driven by motor 41 through a drive tube drive assembly, generally indicated by the numeral 55. The drive tube drive assembly 55 includes a slide guide, generally indicated by the numeral 56, which is a generally elongate, cylindrical member that has a substantially circular outer surface 57 that freely rotatably mounts the worm wheel 54 positioned within the drive train enclosure 50. The slide guide 56 has internal surfaces 58 that are non-circular and, in cross section, substantially match the out of round configuration of the drive tube 31. Thus, the slide guide 56 and drive tube 31 are non-rotatably interrelated, such that drive tube 31 moves rotationally with slide guide 56 at all times. The slide guide 56 is maintained at a fixed position axially of the drive tube 31 by interengagement with the drive train enclosure 50 and worm wheel 54. Proximate the axial extremity of the circular outer surface 57 of slide guide 56 are a plurality of spring catches 59. As shown, there are four spring catches 59, which are equally spaced about the outer periphery of the outer surface 57 of slide guide 56. When the slide guide 56 is positioned inside worm wheel 54, the spring catches 59 abut the axial surface 60 of the worm wheel 54.

The drive tube drive assembly 55 also includes an end cap 61 that interfits within the cylindrical journal 53 of the drive train enclosure, as best seen in FIG. 4. Thus, the spring catches 59 of slide guide 56 are interposed between and thus axially restrained by axial surface 60 of worm wheel 54 and the end cap 61. Movement of the worm wheel 54 in an axial direction opposite the end cap 61 is precluded by a radially in-turned flange 62 in the cylindrical journal 53 of drive train enclosure 50. The end cap 61 has a radial inner rim 63 that serves as a bearing surface for the axially outer surface of circular outer surface 57 of slide guide 56 that extends axially beyond the spring catches 59 (see FIGS. 3 and 4).

The circular outer surface 57 of slide guide 56 has circumferentially-spaced, axial-extending grooves 65 for a purpose to be detailed hereinafter. The axial extremity of slide guide 56 opposite the axial outer surfaces 64 may be provided with encoder notches 66 to generate encoder signals representative of door position and movement for door control system functions of a type known to persons skilled in the art.

Drive tube drive assembly 55 has a disconnect sleeve, generally indicated by the numeral 70, which is non-rotatably mounted on, but slidable axially of, the slide guide 56. As best seen in FIG. 3, the disconnect sleeve 70 has a generally cylindrical inner surface 71 that is adapted to slidingly engage the circular outer surface 57 of slide guide 56. The inner surface 71 has one or more tabs 72 that are inwardly raised, axially-extending surfaces, which are adapted to matingly engage the axially-extending grooves 65 of slide guide 56. Thus, when disconnect sleeve 70 is mounted on slide guide 56, with tabs 72 engaging the grooves 65, the disconnect sleeve 70 is free to slide axially of slide guide 56 but is precluded from relative rotation. The axial extremity of disconnect sleeve 70, which faces the worm wheel 54 has a plurality of circumferentially-spaced, projecting teeth 73, as seen in FIGS. 2 and 3. The teeth 73 selectively engage and disengage spaced circumferential recesses 74 in the axial extremity of worm wheel 54 opposite the axial surface 60.

The selective engagement and disengagement of the disconnect sleeve 70 with the worm wheel 54 is controlled by a disconnect actuator, generally indicated by the numeral 80. The disconnect actuator 80 has a disconnect bracket, generally indicated by the numeral 81. The disconnect bracket 81 is generally L-shaped, with a triangular projection 82 that has a ring-shaped receiver 83 that seats the disconnect sleeve 70. The disconnect sleeve 70 has circumferentially-spaced, radially-outwardly extending catches 84 that engage one axial side of ring-shaped receiver 83. The disconnect sleeve 70 also has a flange 85 at the axial extremity opposite the teeth 73 and catches 84, such as to maintain disconnect sleeve 73 axially affixed to receiver 83 but freely rotatable relative thereto.

The disconnect bracket 81 has a right angle arm 86 relative to the triangular projection 82, which is movably affixed to the mounting plate 37 of operator housing 35. As best seen in FIG. 3, the arm 86 has a pair of spaced lateral slots 87 through which headed lugs 88 project to support the disconnect bracket 81 and limit its motion to an axial direction whereby the disconnect bracket 81 moves the disconnect sleeve 70 directly axially into and out of engagement with the worm wheel 54.

The disconnect actuator 80 also has a disconnect plate 90 which overlies the disconnect bracket 81, as best seen in FIG. 2. The disconnect plate 90 has a downwardly and laterally oriented slot 91 which receives a headed lug 92 which is affixed to the arm 86 of disconnect bracket 81. It will thus be appreciated that the component of lateral movement affected by upward or downward displacement of disconnect plate 90 is transmitted via lug 92 to lateral motion of the disconnect bracket 81 on lugs 88 to axially displace disconnect sleeve 70 in and out of engagement with worm wheel 54.

Still referring to FIG. 2, the vertical movement of disconnect plate 90 of disconnect actuator 50 to move disconnect sleeve 70 from the engaged position depicted upwardly as indicated by the arrows toward the disengage position is effected by a cable C. The disconnect plate 90 has a guide loop 95 which slidably engages the cable C. The disconnect plate 90 has a projecting arm 96 to which one end of a tension spring 97 is connected. The other end of tension spring 97 is attached to a fixed tab 98 which, as shown, may be formed in the mounting plate 37 of operator housing 35. It is to be appreciated that the spring 97 eliminates any slack in the cable C while biasing disconnect plate 90 downwardly as viewed in FIG. 2 to continually urge the disconnect sleeve 70 toward engagement with worm wheel 54.

The cable C is positioned to permit adjustment upon vertical movement of guide loop 95 by a pair of cable guides 100 which may be attached to or, as shown, formed from mounting plate 37 of operator housing 35. One run of cable C is directed to a further cable guide 101 and around a pivot pin 102 which affects a redirection toward the operator motor assembly 40. The cylindrical portion 44 of motor cover 43 has a bifurcated hook 103 which retains an end pin 104 on the end of cable C. The other run of cable C extends through an aperture 110 in mounting plate 37 of operator housing 35 (FIG. 2).

Figure 6:
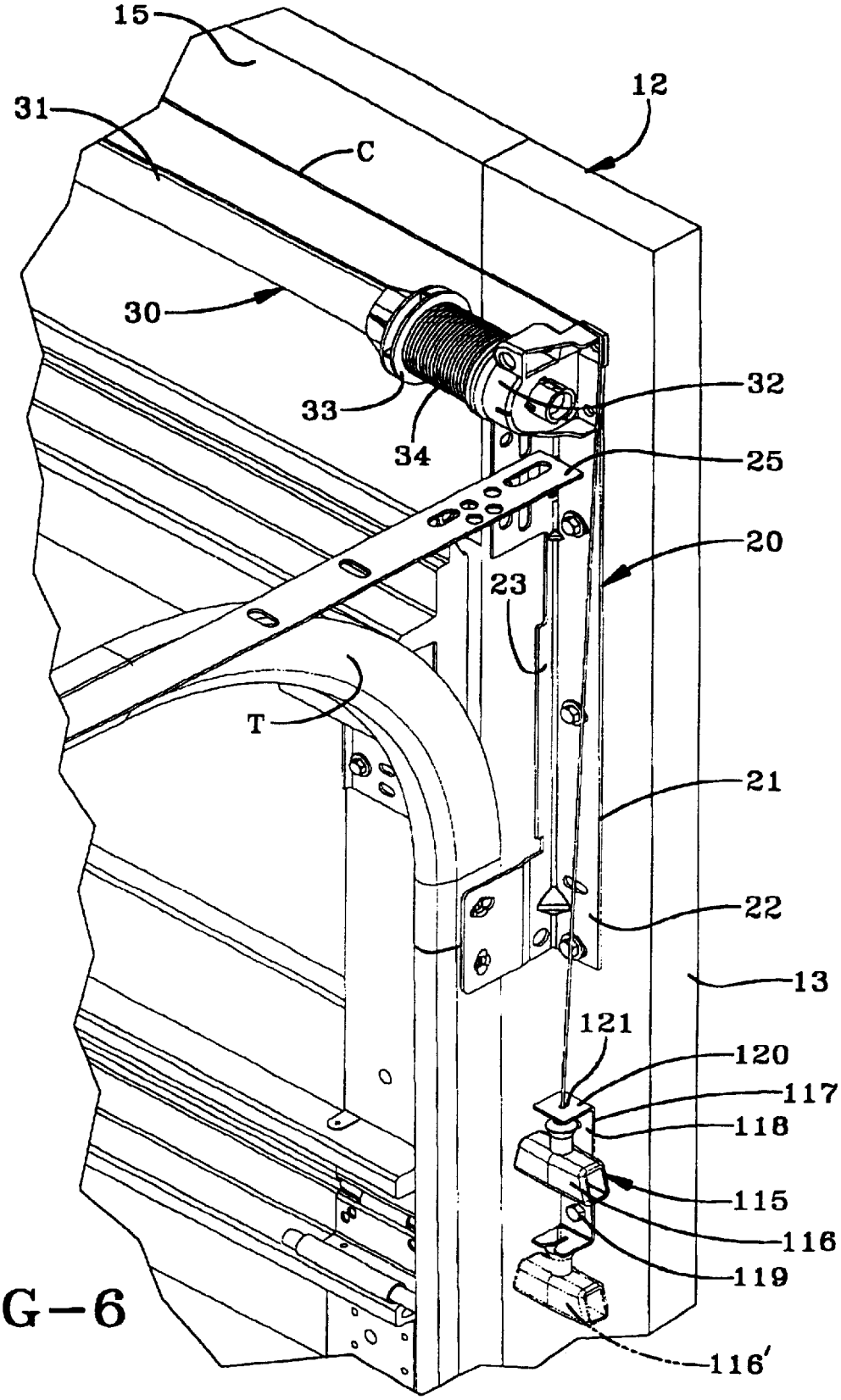
FIG. 6 is an enlarged fragmentary portion of the sectional overhead door installation of FIG. 1 showing details of the placement and structure of the manual disconnect assembly.

Referring to FIGS. 1 and 6, the cable C is routed over a tensioning assembly 32 of counterbalance system 30 to a handle assembly, generally indicated by the numeral 115. The handle assembly 115 includes a T-shaped handle 116 which terminates the cable C. Handle assembly 115 also includes a U-shaped plate 117 having a base 118 which may be affixed to a door jamb 13 as by a cap screw 119, or other suitable fastener, at a location which is convenient for disconnecting the door but sufficiently displaced from windows in the door D or in the garage structure to preclude actuation of the handle 116 by a potential intruder outside the garage. The U-shaped plate 117 has an outwardly projecting arm 120 with a bore 121 sized to freely receive the cable C but serving as a stop for T-shaped handle 116 with the cable tensioned and the disconnect actuator 80 in the position depicted in FIG. 2 with the disconnect sleeve 70 engaging the worm wheel 54. U-shaped plate 117 has a second projecting arm 122 having a V-shaped slot 123 therein. As seen in FIG. 6 the T-shaped handle 116 may be pulled downwardly to reside in a second position 116' with the cable inserted in V-shaped slot 123. At such time, the operator motor assembly 40 is in the operate position, i.e. substantially perpendicular to the door D, and the disconnect actuator 80 is moved to the disengage position where the disconnect sleeve 70 is out of engagement with the worm wheel 54. Thus, in the second position of T-shaped handle 116', the operator motor assembly 40 is in the operating position and the drive tube drive assembly 55 has disconnected the motor 41 and the drive tube 31, such that the door can be freely manually raised or lowered as assisted by the counterbalance system 130.

The run of cable C which extends out of the operator housing 35 may include an anti-intrusion member, generally indicated by the numeral 125. As best seen in FIG. 2 the anti-intrusion member consists of a cylindrical cable crimp 126 which is attached to the cable C. As can be seen in FIG. 2 the cable crimp 126 is positioned within the operator housing 35 and is spaced a short distance from aperture 110 when the disconnect actuator 80 is in the engaged position with the disconnect sleeve 70 in engagement with the worm wheel 54. If the handle assembly 115 is operated by pulling downwardly so that cable C proximate the aperture 110 is displaced directly axially, the cable crimp 126, which has a lesser diameter than the aperture 110, moves freely through the aperture 110 to affect the disconnect function. However, in the event of an attempted unauthorized entry, as through a window in the door D, a displacement of cable C by reaching inwardly and upwardly and pulling downwardly on the cable C will advance the cable C and cable crimp 126 other than directly axially, such that the cable crimp 126 will engage housing 35 in the area surrounding aperture 110 and thus preclude movement of the cable C sufficient to carry out a movement of the disconnect sleeve to a position where it is disengaged from worm wheel 54.

Figure 5:
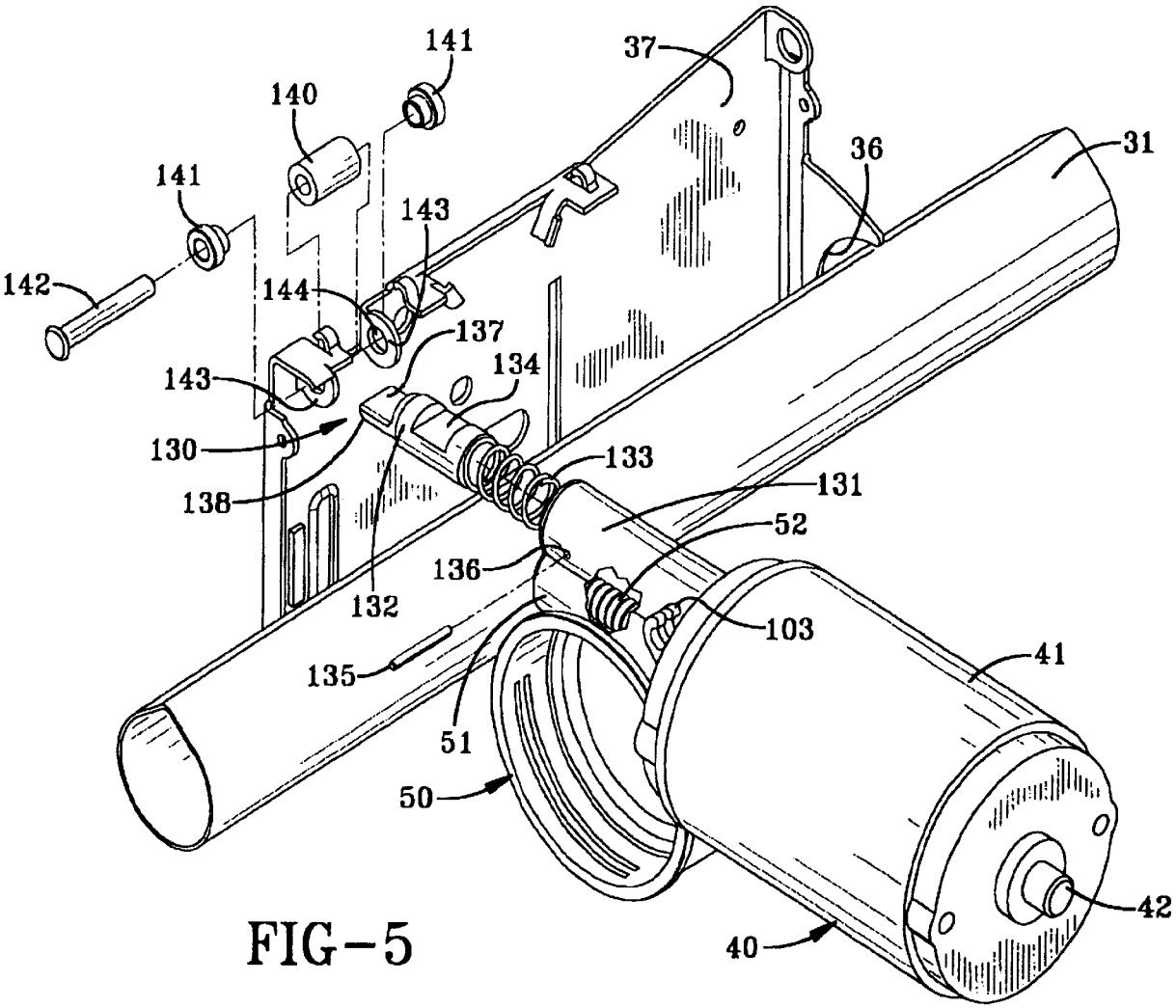
FIG. 5 is an exploded perspective view showing details of operative components of the retaining assembly which selectively secures the operator in the door operating position.

The operator motor assembly 40 is selectively secured in the door operating position during the normal torque range attendant the moving of door D in upward and downward directions by a motor retaining assembly generally indicated by the numeral 130. As seen in FIGS. 3–5, the motor retaining assembly 130 includes a tubular projection extending from motor cover 43 and which may be adjacent to the drive train enclosure 50. Tubular projection 131 houses a plunger 132 which is biased outwardly of tubular projection 131 by a compression spring 133. The plunger 132 is maintained within tubular projection 131 and its axial throw therein is controlled by a slot 134 in the plunger 132 which receives a pin 135 extending through bores 136 in the tubular projection 131. The projecting extremity of plunger 152 has a flat contact surface 137 which terminates in a rounded extremity 138.

The plunger 132 of motor retaining assembly 130 operatively engages a fixed cylindrical stop 140. The stop 140 is mounted between a pair of friction washers 141 on a shaft 142 as is seen in detail in FIG. 5. The shaft 142 supporting cylindrical stop 140 is retained by a pair of spaced ears 143 having bores 144 supporting the shaft 142. As shown, the ears may be formed in the mounting plate 37 of operator housing 35. As may be appreciated from FIGS. 2, 4 and 5 of the drawings, the flat contact surface 137 of plunger 132 underlies the cylindrical stop 140 with the door in the operating position. The plunger 132 pivots away from the fixed cylindrical stop when the operator motor assembly 40 is in the locked position depicted in chain lines at 40' in FIG. 1. When moving from the locked position to the operating position, the operator motor assembly 40 moves upwardly until the rounded extremity 138 of plunger 132 engages the cylindrical stop 40 which commences compression of the spring 133. When operator motor housing 40 reaches the operating position depicted at 40 in FIG. 1 in a position substantially perpendicular to the door D, the engaging surface 138 as urged by spring 133 rotates cylindrical stop 140 such that the flat contact surface 137 is positioned under the cylindrical stop 140. The flat contact surface 137 moves out from under roller 130 when sufficient torsional forces are placed upon operator motor assembly 40, thereby releasing from the motor retaining assembly 130.

Figure 7:
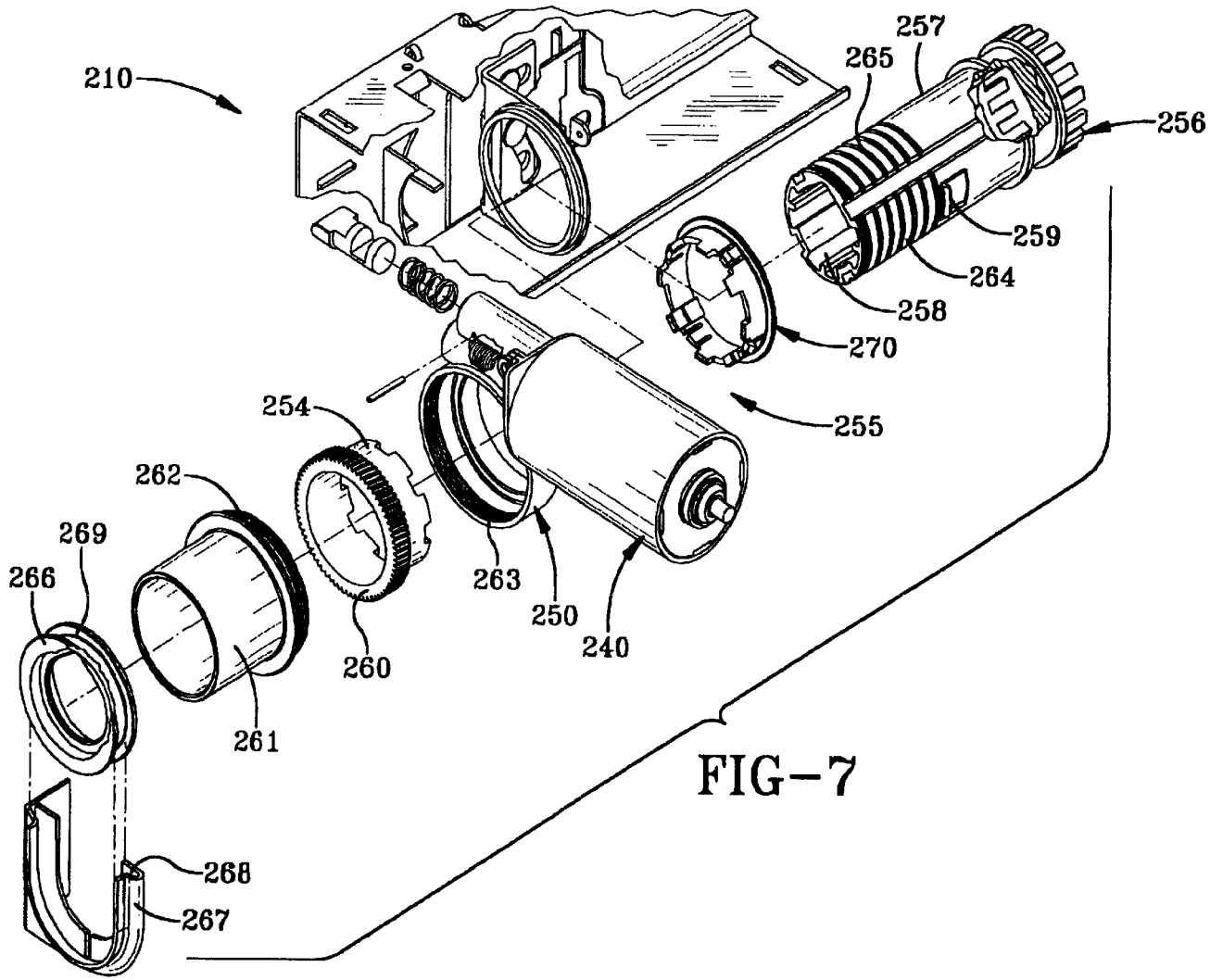
FIG. 7 is an enlarged exploded perspective view showing details of an alternate embodiment of drive tube drive assembly according to the concepts of the present invention.
Figure 8:
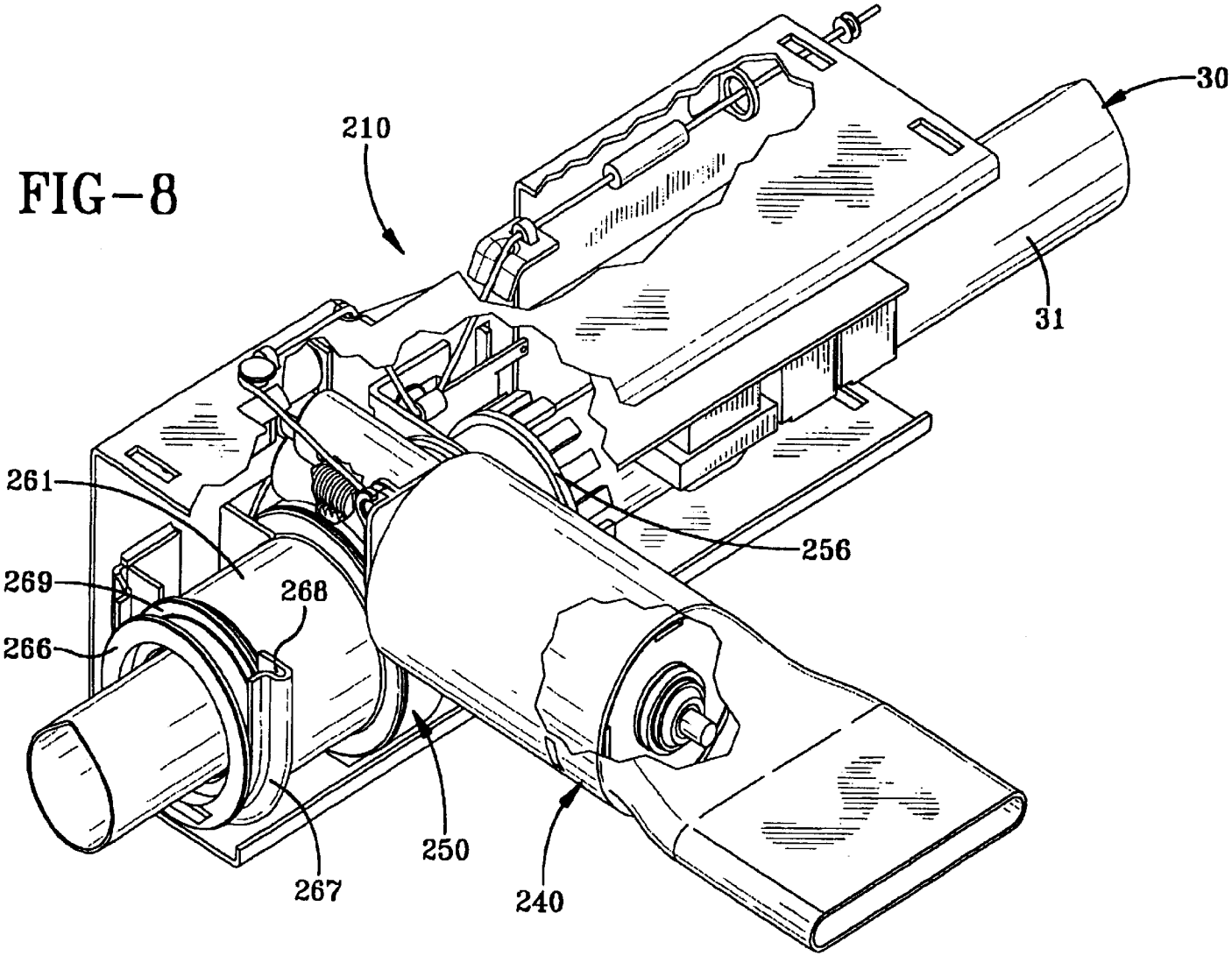
FIG. 8 is a perspective view of the motorized operator of the alternate embodiment of FIG. 7 with the gear removed to show the mechanical interconnection of the motorized operator with the drive tube of the counterbalancing system in the assembled configuration.

In instances of wider or heavier doors D, an alternative embodiment operator system 210 shown in FIGS. 7 and 8 maybe provided. Operator system 210 may have an operator motor assembly, generally indicated by the numeral 240, which may be essentially identical to the operator motor assembly 40. Operator system 210 also has a drive train enclosure, generally indicated by the numeral 250, which may be substantially similar to the drive train enclosure 50 and interact with a counterbalance system 30 and drive tube 31 constructed as described hereinabove.

The differences in operator system 210 reside primarily in the drive tube drive assembly, generally indicated by the numeral 255. As best seen in FIG. 7, drive tube drive assembly 255 includes a slide guide, generally indicated by the numeral 256, which is a generally elongate cylindrical member that has a substantially circular outer surface 257 that freely rotatably mounts the worm wheel 254 positioned within the drive train enclosure 250. The slide guide 256 has internal surfaces 258 that are non-circular and, in cross section, substantially match the outer out-of-round configuration of the drive tube 31. Thus the slide guide 256 and drive tube 31 are non-rotatably interrelated, such that drive tube 31 moves rotationally with slide guide 256 at all times. The slide guide 256 is maintained in a fixed position axially of the drive tube 31 by interengagement with the drive train enclosure 250 and the worm wheel 254. The circular outer surface 257 of slide guide 256 has one or more spring catches 259 which extend outwardly of the outer surface 257. When the slide guide 256 is positioned inside worm wheel 254 within drive train enclosure 250 the spring catch 259 abuts the axially outer surface 260 of the worm wheel 254.

An elongate bearing sleeve 261 having external threads 262 is threaded into internal threads 263 in the drive train enclosure 250. Once threaded into position, the bearing sleeve 261 receives the cylindrical extension 264 on slide guide 256. The cylindrical extension 264 may be provided with spaced circumferential grooves 265 which reduce contact area and thus friction between cylindrical extension 264 and bearing 261, while providing stabilization by contact over a substantial length. The extremity of bearing sleeve 261 opposite the threads 262 is supported in a bushing 266 as best seen in FIG. 7. A U-shaped wall support 267 having a groove 268 for receiving a flange 269 on bushing 266 maintains the bearing sleeve 261 in a fixed anchored position. A disconnect sleeve, generally indicated by the numeral 270 is structured and interacts with the slide guide 256 in the manner of the disconnect sleeve 70 described hereinabove. It will thus be appreciated that in operator system 210 the operator motor assembly 240 is supported to either side of drive train enclosure 250, i.e., through the disconnect sleeve 270 and the bearing sleeve 261.

In the operation of both embodiments of the invention when the door D is closing the operator motor assembly 40 is in the operating position depicted in FIG. 1 with the disconnect sleeve 70 engaging the worm wheel 54 so that motor 41 is releasing cable 34 from the counterbalance system 30. At this time the motor retaining assembly 130 maintains the operator motor assembly 40 in the operating position. When the door D reaches the closed position the torque of motor 41 tends to rotate the operator motor assembly 40 about the drive tube 31 such that the rotational resistance provided by motor retaining assembly 130 is overcome, whereby the flat contact surface 137 of plunger 132 rotates away from the fixed cylindrical stop 140. Continued operation of motor 41 rotates the operator motor assembly 40 through approximately 90 degrees until the motor cover 43 engages the top panel P of the door D to thereby lock the door D in the closed position. The torsional resistance provided by the door D is sensed by controls of operator motor assembly 40 and operation of motor 41 is discontinued.

It is to be appreciated that operator motor assembly 40 may assist in seating the door D in the fully closed position, if necessary. In some, particularly low headroom, arrangements of doors, tracks and rollers, there may be instances where the top panel is not fully seated when the door is ostensibly in the closed position. In such cases, the rotation of operator motor assembly 40 may be employed to fully seat the top panel P of door D in the closed position preparatory to assuming the locked position.

When the door D and operator motor assembly 40 are actuated to effect opening of the door D, the operator motor assembly 40 rotates from the locked position to the operating position prior to movement of the door D. As the operator motor assembly 40 approaches the operating position, the spring loaded plunger 132 engages cylindrical stop 140 and depresses spring 133 until the force of plunger 132 and the rotation of the operator motor assembly move operator motor assembly 40 into the operating position secured by motor retaining assembly 130. Thereafter continued actuation of motor 41 proceeds in normal opening of the door D with the operator motor assembly 40 remaining in the operating position during the opening and closing sequence until the door D again reaches the closed position as described hereinabove.

During the normal operating cycle the disconnect actuator 80 is positioned as shown in FIG. 2 with the disconnect sleeve 70 engaging the worm wheel 54. Should an obstruction be encountered during lowering of the door D, the handle 116 may be moved from solid line position 116 to the second, chain line position 116' to move disconnect plate 90, disconnect actuator 80 and thus the disconnect sleeve 70 from the engaged position with worm wheel 54 to the disengaged position. Thus disengaged from operator motor assembly 40, the door D may be freely raised or lowered manually until such time as the handle 116 is released from the second position 116' and allowed to resume the first, solid line position, thereby engaging the disconnect sleeve 70 with worm wheel 54. The operator motor assembly 40 may be provided with a mercury switch S (FIG. 2) or other indicator to signal rotation of the motor 41 from the operating position as a secondary indicia of contact with an obstruction when the door D is not in the closed position.

It is to be appreciated that the handle assembly 115 may be actuated from the first position to the second disengaged position when the door D is in the closed position. In such instance, it is to be noted that the cable C will manually affect both a pivoting of the operator motor assembly 40 from the locked position to the operating position and disengagement of disconnect sleeve 70 from worm wheel 54 such that the door can be manually raised and manipulated as necessary, as in the event of a power loss.

Thus, it should be evident that the overhead door locking operator disclosed herein carries out one or more of the objects of the present invention set forth above and otherwise constitutes an advantageous contribution to the art. As will be apparent to persons skilled in the art, modifications can be made to the preferred embodiments disclosed herein without departing from the spirit of the invention, the scope of the invention herein being limited solely by the scope of the attached claims.

What is claimed is:

1. An operator for moving in upward and downward directions a sectional door having a counterbalancing system including a drive tube interconnected with the door comprising, a reversible motor, a drive gear selectively driven in two directions by said motor, a driven gear adapted to be freely rotatably mountable on the drive tube and engaging said drive gear, a slide guide adapted to be non-rotatably mounted on the drive tube, a disconnect mounted on said slide guide and selectively movable between a first position rotatably connecting said driven gear and said slide guide and a second position disconnecting said drive gear and said slide guide, and a gear housing supporting said motor for moving between a door operating position and a door locking position, wherein said housing is pivotally mounted for movement between said door operating position and said door locking position.

2. An operator according to claim 1, further comprising an actuator for selectively moving said disconnect between said first position and said second position allowing manual movement of the door.

3. An operator according to clam 2, wherein said actuator includes a pull handle and a cable operatively interconnected with said disconnect.

4. An operator according to claim 3, wherein said actuator includes an anti-intrusion mechanism for precluding activation of said disconnect when an unauthorized entry is attempted.

5. An operator according to 1, wherein said disconnect is axially movable along said slide guide.

6. An operator according to claim 5, wherein said disconnect has a sleeve and said slide guide has an outer cylindrical surface which engages said sleeve of said disconnect.

7. An operator according to claim 6, wherein said sleeve has at least one axial tab and at least one axial groove on said slide guide for receiving said tab to preclude relative rotation between said sleeve and said slide guide while permitting axial sliding engagement.

8. An operator according to claim 6, wherein said disconnect includes a bracket carrying said sleeve and said actuator has a cable for moving said disconnect between said first position and said second position.

9. An operator according to claim 8, wherein said disconnect includes a spring for biasing said bracket from said second position toward said first position.

10. An operator according to claim 1, wherein said drive gear is a worm and said driven gear is a worm wheel.

11. An operator according to claim 1, wherein said disconnect has axially projecting teeth and said driven gear has slots which matingly engage when said disconnect is in said first position.

12. An operator according to claim 1, wherein said gear housing circumscribes said driven gear and said drive gear for maintaining said driven gear and said drive gear in mating engagement during pivoting of said motor between said door operating position and said door locking position.

13. An operator according to claim 1, wherein said motor is adapted to contact the door in said door locking position and is substantially perpendicular thereto in said door operating position.

14. An operator for moving in upward and downward directions a sectional door having a counterbalancing system including a drive tube interconnected with the door comprising, a reversible motor, a drive gear selectively driven in two directions by said motor, a driven gear adapted to be freely rotatably mountable on the drive tube and engaging said drive gear, a slide guide adapted to be non-rotatably mounted on the drive tube, a disconnect mounted on said slide guide and selectively movable between a first position rotatably connecting said driven gear and said slide guide and a second position disconnecting said drive gear and said slide guide, a gear housing supporting said motor for moving between a door operating position and a door locking position, and a retaining assembly to secure said motor in said door operating position during the normal operating torque range attendant the moving of the door in the upward and downward directions, wherein said motor carries a plunger which is adapted to engage a fixed stop, and wherein said plunger is spring loaded for urging said plunger into engagement with said fixed stop.

15. An operator according to claim 14, wherein said retaining assembly includes a tubular projection attached to said motor for housing said plunger and said fixed stop includes a cylindrical roller.

16. An operator according to claim 15, wherein said plunger has a flat engaging surface which tangentially engages said cylindrical roller to selectively maintain said motor in said door operating position.

17. A system for raising and lowering a sectional overhead door between an open position and a closed position comprising, a counterbalance system adapted to be connected to the sectional overhead door, an operator motor assembly adapted to be mounted proximate to the sectional overhead door in the closed position of the sectional overhead door, at least a portion of said operator motor assembly moveable between a door operating position and a door locking position, wherein said portion of said operator motor assembly is adapted to engage the sectional overhead door in said door locking position, a disconnect for selectively connecting said operator motor assembly and said counterbalance system and disconnecting said operator motor assembly and said counterbalance system, and an actuator operative to both disconnect said operator motor assembly and said counterbalance system and move said operator motor assembly from said door locking position to said door operating position, whereby the door may be manually raised from the closed position.

18. A system according to claim 17, wherein said portion of said operator motor assembly is pivotally mounted for movement between said door operating position and said door locking position.

19. A system according to claim 17, further comprising an anti-intrusion mechanism associated with said actuator.

20. A system according to claim 17 further comprising, a retaining assembly for maintaining said operator motor assembly in said door operating position during normal raising and lowering of the door.

21. A system according to claim 17, wherein said operator motor assembly is positioned within the confines of the door and said counterbalance system during raising and lowering of the door.

22. A system according to claim 17, wherein said portion of said operator motor assembly system includes a motor.

23. A system according to claim 17, wherein said portion of said operator motor assembly includes a motor cover.

24. A system according to claim 17, wherein said portion of said operator motor assembly includes a drive train enclosure.

25. A system according to claim 17, further comprising a disconnect for selectively connecting said operator motor assembly and said counterbalance system and disconnecting said operator motor assembly and said counterbalance system.

26. A system for raising and lowering a sectional overhead door between an open position and a closed position comprising, a counterbalance system adapted to be connected to the sectional overhead door, an operator motor assembly adapted to be mounted proximate to the sectional overhead door in the closed position of the sectional overhead door, at least a portion of said operator motor assembly moveable between a door operating position and a door locking position, wherein said portion of said operator motor assembly is adapted to engage the sectional overhead door in said door locking position, and a switch associated with said operator motor assembly for signaling movement of said operator motor assembly from said operating position toward said door locking position when the door is not in the closed position.

27. A system according to claim 26, wherein said operator motor assembly is supported to either side thereof.

* * * * *